US009879461B2

(12) United States Patent
Conway

(10) Patent No.: US 9,879,461 B2
(45) Date of Patent: Jan. 30, 2018

(54) PARTITION AND CLOSING SYSTEM FOR PARTITION

(71) Applicant: BOBRICK WASHROOM EQUIPMENT, INC., North Hollywood, CA (US)

(72) Inventor: William Conway, Moorpark, CA (US)

(73) Assignee: BOBRICK WASHROOM EQUIPMENT, INC., North Hollywood, CA (US)

( * ) Notice: Subject to any disclaimer, the term of this patent is extended or adjusted under 35 U.S.C. 154(b) by 0 days.

(21) Appl. No.: 15/041,707

(22) Filed: Feb. 11, 2016

(65) Prior Publication Data

US 2016/0258200 A1 Sep. 8, 2016

Related U.S. Application Data

(60) Provisional application No. 62/128,403, filed on Mar. 4, 2015.

(51) Int. Cl.

| | |
|---|---|
| ***E05D 11/10*** | (2006.01) |
| ***E05F 5/02*** | (2006.01) |
| ***E06B 3/36*** | (2006.01) |
| ***E06B 5/00*** | (2006.01) |
| ***E05C 19/16*** | (2006.01) |

(Continued)

(52) U.S. Cl.

CPC ..... *E05F 5/02* (2013.01); *E05B 63/0008* (2013.01); *E05C 19/16* (2013.01); *E05F 7/04* (2013.01); *E06B 3/36* (2013.01); *E06B 5/00* (2013.01); *E05Y 2201/46* (2013.01); *E05Y 2900/132* (2013.01); *E05Y 2900/142* (2013.01)

(58) Field of Classification Search

CPC ..... E05F 5/02; E05F 7/04; E06B 3/36; E06B 5/00; E05C 19/16; E05Y 2201/46

USPC ..... 16/320, DIG. 14

See application file for complete search history.

(56) References Cited

U.S. PATENT DOCUMENTS 2,240,482 A 12/1938 Anderson
3,420,562 A * 1/1969 Simon ..... E05C 19/16 292/251.5

(Continued)

FOREIGN PATENT DOCUMENTS

DE 195 01 033 A1 7/1996
DE 195 26 618 A1 1/1997

(Continued)

OTHER PUBLICATIONS

PCT Search Report and Written Opinion dated May 9, 2016 for International Application No. PCT/US2016/017532, 10 pages.

(Continued)

*Primary Examiner* — Jerry Redman

(74) *Attorney, Agent, or Firm* — Lewis Roca Rothgerber Christie LLP

(57) ABSTRACT

A partition door system includes a partition door, a stile, and a closing mechanism coupling the partition door to the stile, such that the closing mechanism provides a force for closing the door relative to the stile. A first magnet is at the partition door proximate the stile, and a second magnet is at the stile proximate the door. A partition door including a magnet, a stile including a magnet and a method of operating the same are also provided.

16 Claims, 3 Drawing Sheets

(51) Int. Cl.
*E05F 7/04* (2006.01)
*E05B 63/00* (2006.01)

(56) References Cited

U.S. PATENT DOCUMENTS

| | | | | | |
|---|---|---|---|---|---|
| 3,707,017 | A * | 12/1972 | Paquette | E05D 1/00 | 16/385 |
| 4,881,353 | A | 11/1989 | Braendel et al. | | |
| 5,210,906 | A * | 5/1993 | Aihara | B60R 7/04 | 16/232 |
| 5,437,065 | A | 8/1995 | Sakawa | | |
| 5,630,302 | A | 5/1997 | Rosenband | | |
| 6,408,484 | B1 * | 6/2002 | Vandertouw | E05D 11/1028 | 16/320 |
| 7,987,635 | B2 | 8/2011 | Thielke | | |
| 9,260,861 | B2 | 2/2016 | Babikian | | |
| 2005/0062296 | A1 * | 3/2005 | Lyon | E05C 19/16 | 292/251.5 |
| 2006/0170225 | A1 * | 8/2006 | Macken | E05C 19/16 | 292/251.5 |
| 2006/0254025 | A1 * | 11/2006 | Danko | E05D 1/00 | 16/320 |
| 2007/0151077 | A1 * | 7/2007 | Wei | E05F 1/00 | 16/320 |
| 2007/0157432 | A1 * | 7/2007 | Weinstein | E05D 11/00 | 16/320 |
| 2009/0007504 | A1 | 1/2009 | Thielke et al. | | |
| 2014/0041304 | A1 * | 2/2014 | Martin | E05D 15/0626 | 49/352 |
| 2015/0308172 | A1 * | 10/2015 | Veino | E05D 7/1061 | 49/380 |

FOREIGN PATENT DOCUMENTS

| | | | | |
|---|---|---|---|---|
| DE | 199 18 099 | A1 | 10/2000 | |
| DE | 203 08 167 UI | | 9/2004 | |
| DE | 20 2011 005 266 UI | | 7/2011 | |
| DE | 10 2011 103 554 | A1 | 12/2012 | |
| DE | 10 2011 114 361 | A1 | 3/2013 | |
| EP | 0 893 556 | A1 | 1/1999 | |
| FR | 3016386 | A1 * | 7/2015 | E05D 15/50 |
| GB | 685404 | A * | 1/1953 | E05C 19/16 |
| GB | 1530591 | A * | 11/1978 | E05C 19/16 |
| GB | 2 445 031 | A | 6/2008 | |
| WO | WO 2012017924 | A1 * | 2/2012 | E05D 1/06 |

OTHER PUBLICATIONS

PCT Search Report and Written Opinion for International Application No. PCT/US2014/026478, dated Dec. 8, 2014, 11 pages.
Thrislington Cubicles, Advanced Design in Fitting Room Systems; Brochure, Printed Apr. 1991, Pacoima, CA, 4 pages.

* cited by examiner

PARTITION AND CLOSING SYSTEM FOR PARTITION

CROSS-REFERENCE TO RELATED APPLICATION

This application is based upon and claims priority to U.S. Provisional Application Ser. No. 62/128,403, filed on Mar. 4, 2015, entitled "PARTITION AND CLOSING SYSTEM FOR PARTITION", the contents of which are fully incorporated herein by reference.

BACKGROUND OF THE INVENTION

Bathroom partition doors include a closing mechanism such as a cammed hinge, or an internal spring hinge, or a piano hinge with springs, or a hydraulic cylinder, coupling the partitions to corresponding stiles, or fascia panels (individually or collectively referred to herein as "stiles"). The closing mechanism helps close the partition after it is opened. Typically, the force provided by the closing mechanism on such doors, as for example the spring force is set high because, under the Americans with Disabilities Act, the torque on the hinge has to be strong enough to keep the door closed at all times. When the door is opened at an angle of 90 degrees or more, the torque provided by the closing mechanism to close the door is at its highest. As the door moves towards the closed position, the closing mechanism torque continues to decrease, yet remains strong enough, causing the door to slam against another stile, causing an unacceptable noise and vibration to the toilet partition system. As the door slams to the closed position, the force from slamming causes the door to re-open and slam again towards the closed position. This process repeats itself, with each cycle the door opening less and less, until the door remains closed, causing undue vibration. Thus, a toilet partition system that allows for the closing of the toilet partition without such slamming against the closing fascia is desired.

SUMMARY OF THE INVENTION

In an example embodiment, a partition door system includes a partition door, a stile, and a closing mechanism coupling the partition door to the stile, such that the closing mechanism provides a force for closing the door relative to the stile. A first magnet is at the partition door proximate the stile, and a second magnet is at the stile proximate the door. In another example embodiment, the door rotates about a longitudinal axis between the partition door and the stile. In yet another example embodiment, the door has an upper end and a lower end and the stile has an upper end and a lower end, and the first magnet is proximate the upper end of the door and the second magnet is proximate the upper end of the stile. With this embodiment, the system further includes a third magnet proximate the lower end of the partition door, and a fourth magnet proximate the lower end of the stile. In a further example embodiment, the system further includes a first member at an end of the door proximate the first magnet and the third magnet, and a second member proximate an end of the stile proximate the second magnet and the fourth magnet. In yet a further example embodiment, one of the first and second members defines a longitudinally extending channel and the other of the first and second members defines a longitudinally extending projection such that when the partition door is in a closed position the longitudinally extending projection is received within the longitudinally extending channel. In one example embodiment, the first and third magnets are sandwiched between the door and the first member and the second and fourth magnets are sandwiched between the stile and the second member. In another example embodiment, the system further includes a first member at an end of the door proximate the first magnet and a second member proximate an end of the stile proximate the second magnet. In yet another example embodiment, one of the first and second members defines a longitudinally extending channel and the other of the first and second members defines a longitudinally extending projection such that when the partition door is in a closed position the longitudinally extending projection is received within the longitudinally extending channel. In a further example embodiment, the first magnet sandwiched between the door and the first member and the second magnet is sandwiched between the stile and the second member.

In an example embodiment a method of operating a partition door includes closing the partition door towards a stile, and applying a magnetic force to keep the partition door closed at the stile.

In yet another example embodiment, a partition wall member includes a first end for coupling to another partition wall member, a second end opposite the first end, and a first magnet at the partition wall member at or proximate the second end. In a further example embodiment, the partition wall member has an upper end and a lower end, and the first magnet is proximate the upper end of the partition wall member and the partition wall member further includes a second magnet proximate the lower end of the partition wall member proximate the second end. In one example embodiment, the partition wall member also includes an end member at an end of the partition wall member proximate the first magnet. In another example embodiment, the end member includes at least one of a longitudinally extending channel or a longitudinally extending projection. In another example embodiment, the partition wall member is a door and the other partition wall member is a stile. In yet a further example embodiment, the partition wall member is a stile and the other partition wall member is a door.

DETAILED DESCRIPTION

Figure 1A:
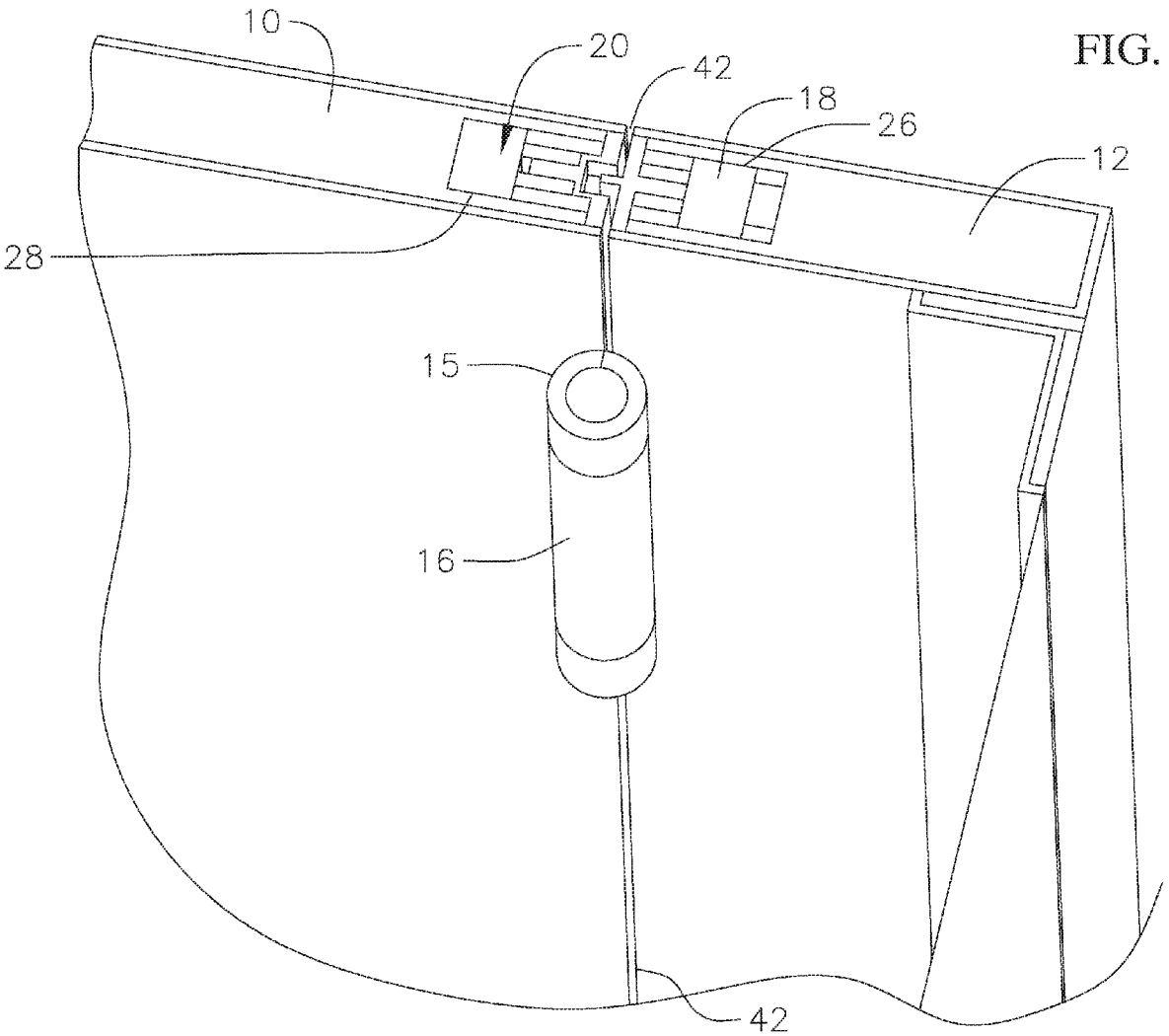
FIG. 1A is a partial top perspective view of an example embodiment partition.
Figure 1B:
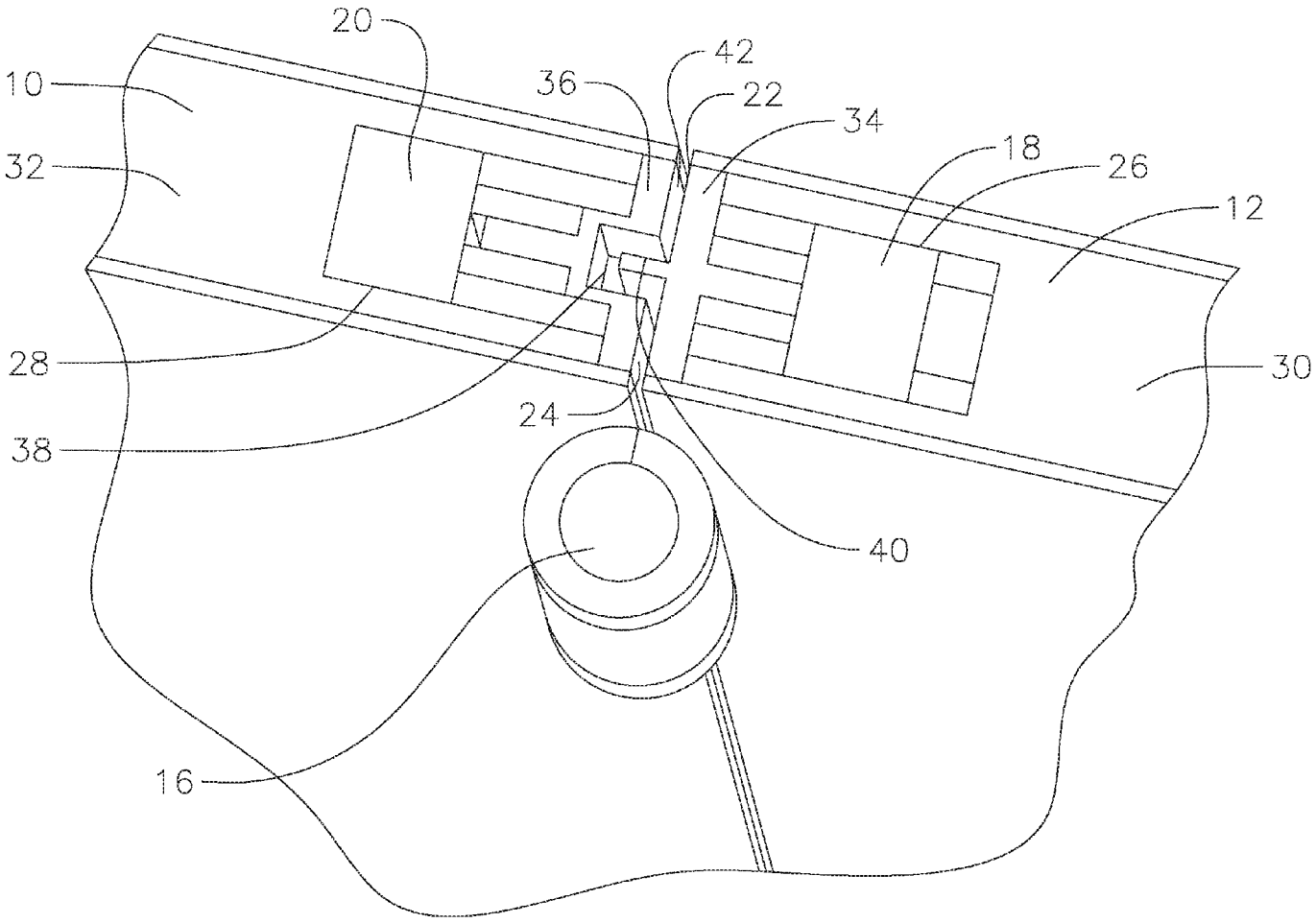
FIG. 1B is an exploded view of a partial section of the partition shown in FIG. 1A.
Figure 2:
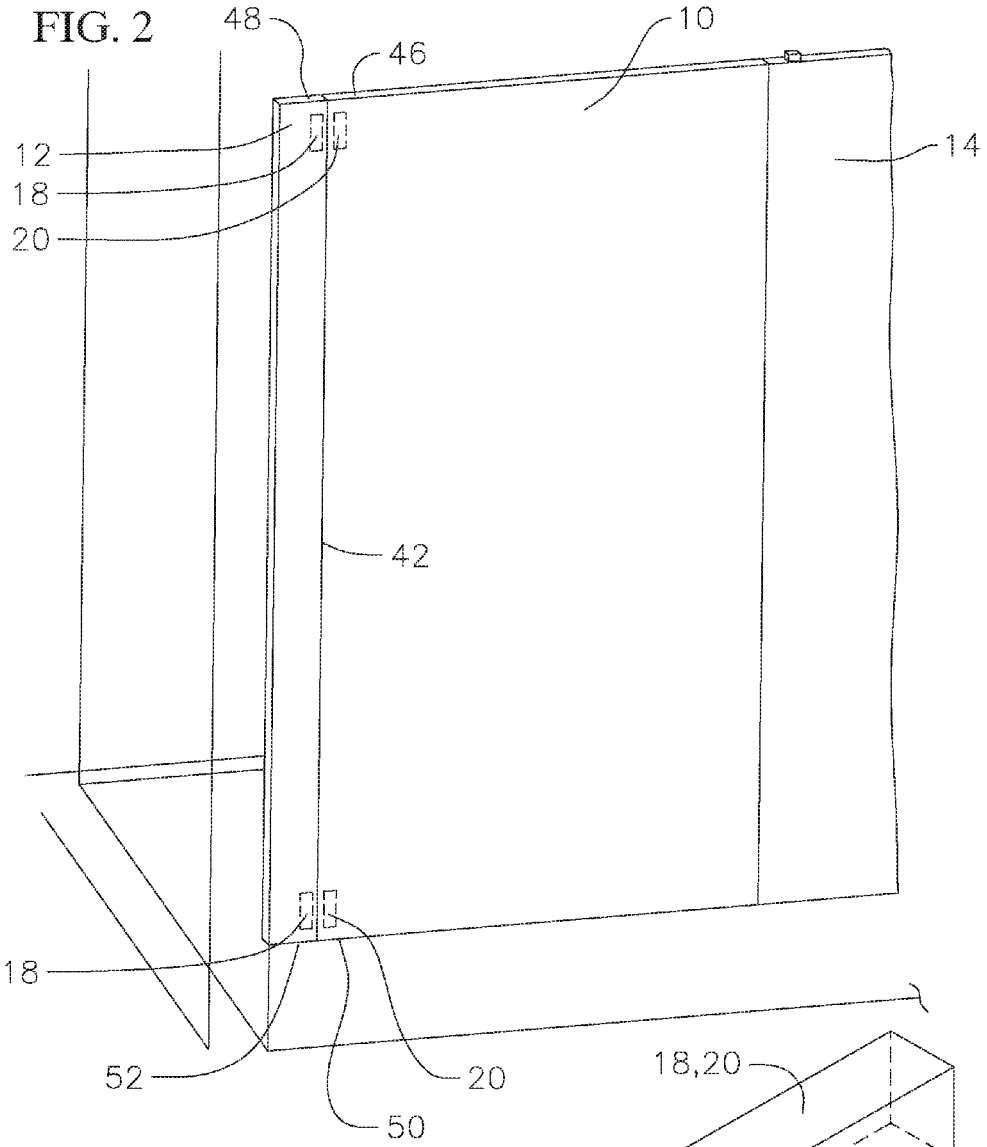
FIG. 2 is a front view of an example embodiment partition showing the location of the magnets.

Typically, a toilet partition door 10 is mounted onto a stile (or fascia) 12, and closes against another stile (or fascia) 14 (FIGS. 1A, 1B and 2). A closing mechanism 16, such as any closing mechanism known in the art (e.g., a cammed hinge, or an internal spring hinge, or a piano hinge with springs, or a hydraulic cylinder) is coupled to on one of the stiles 12 and the partition door 10 so as to allow the partition door to open and to provide a force for closing the door about the stile. In an example embodiment, more than one closing mechanism 16 may be used along the height of the stile and door. However, a single closing mechanism 16 may also be sufficient. In an example embodiment, the door is rotationally coupled to the stile with one or more hinges 15. In the shown example embodiment, the closing mechanism 16 is incorporated in the hinge 15. However, any other type of door closing mechanisms may be used. In an example embodiment, a first magnet 18 is incorporated into the stile and a second magnet 20 is incorporated into the partition door 10 such that the two magnets are on opposite sides of the hinge 15. The first magnet 18 is proximate an end surface 22 of the stile facing an end face 24 of the partition door. The second magnet 20 is proximate the end surface 24 of the partition door facing the end surface 22 of the stile. In other example embodiments, the magnets may be flush with their corresponding end surfaces. In an example embodiment, the two magnets are aligned in height as can be seen in FIG. 2. In this regard, the two magnets will be directly opposite each other. The magnets are also positioned with opposite poles facing each other so that the magnets attract each other.

In an example embodiment, a first pocket 26 is formed into the stile and a second pocket 28 is formed in the partition door, as for example by a machining or other manufacturing methods. The first magnet 18 is received in the first pocket 26 formed in the stile and the second magnet 20 is received in the second pocket 28 formed in the partition door. In one example embodiment, each pocket may be formed through any surface of the door or stile. For example the pocket may be formed from a top surface, or a bottom surface, or an end surface, or a face surface of the door. In another example embodiment, the first pocket 26 extends to a top surface 30 of the stile and the second pocket 28 extends to a top surface 32 of the door. In an example embodiment, the pockets both have a depth that extends to the same height. In the example embodiments shown in FIGS. 1A and 1B, the first pocket 26 also extends to the end surface 22 of the stile and the second pocket 28 also extends to the end surface 24 of the door. In such an embodiment, another member 34, 36 may also respectively included to sandwich and retain each of the magnets 18, 20 within their respective stile and door.

In an example embodiment shown in FIGS. 1A and 1B, the members 34, 36 are extrusions, such as aluminum extrusions, attached, or otherwise held in place, at the end of the stile and door, respectively. In one example embodiment, one of the aluminum extrusions 36 forms a channel 38 while the other extrusion 34 forms a projection 40 to be received in the channel 38, when the partition door is in a closed position relative to the stile. In this regard, when the door closes, the projection is received in the channel and creates a sight block, in that it extends across a seam 42 defined between the stile 12 and the partition door 10 to prevent viewing through the seam. Multiple members or extrusions may be used, as for example one over the other so as to cover a desired portion of the length or the entire length of the door or stile. In an example embodiment, the member or protrusion may run along a length greater than the length of a pocket and may run along the entire height of the partition door. Although in the illustrative example embodiment, the extrusions are made of aluminum, the extrusions may be made from other materials, as for example plastic, or wood, or other metal and may have various shapes and do not necessarily have to include a sight blocking feature.

Figure 3:
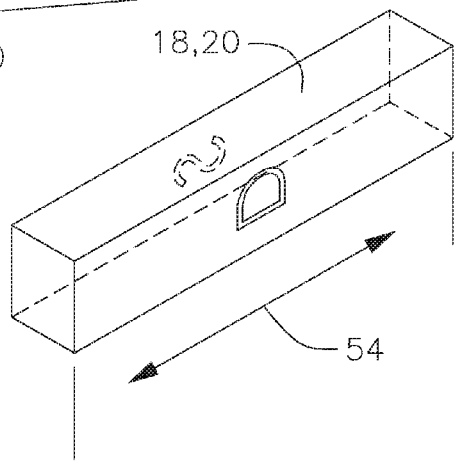
FIG. 3 is a perspective view of an example embodiment magnet incorporated in example embodiment partitions.

In an example embodiment, for a door having a length of 72 inches, two magnets 18, 20 are installed in each of the stile 12 and the door 10. One magnet is installed proximate the top surface 46 of the door, and one proximate the top surface 48 of the stile, and another one proximate bottom surface 50 of the door and another bottom surface 52 of the stile, as for example showing in FIG. 2. In the shown example embodiment, each of the magnets 18, 20 has a length 54 (FIG. 3) of about three inches. One is placed at about half an inch from the end surface 22 of the stile and one is placed about half an inch from the end surface 24 of the door within their corresponding pockets. In the shown example embodiment, for a partition door made of particle board and being 72 inches high by 36 inches wide by about one inch thick, two 3-inch 4500 Gauss magnets are incorporated in each of the partition door (one proximate the top of the door and proximate the bottom of the door) and on each stile (one proximate the top of the stile and proximate the bottom of the stile). These magnets were sufficient to help close the door without slamming and keeping the door closed. This example embodiment door weighs about 75 lbs. With this example embodiment the torque provided by the closing mechanism when the door is 90° open was 20 inch-lbs. The closing mechanism torque required if the magnets were not incorporated for this partition would have been 28 inch-lbs. so as to provide sufficient force to ensure that the door would close at all times. The force required to open the door after closing was minimally increased, or not increased at all, when compared to partition doors without the magnets and incorporating the stronger closing mechanisms.

With this embodiment, the force provided by the closing mechanism, as for example by a spring hinge, to close the door does not have to be that great. In this regard, as the door approaches to a closed position, the door would not slam and cause undue vibration that may be harmful to the partition and stile. In addition, as the door approaches a closed position, the magnets attract and pull the doors closed, and retain the door in the closed position with minimal or no vibration. It should be noted that the magnets are mounted on the stile and door, respectively, such that the north pole of one magnet faces the south pole of the other magnet so that the two magnets can attract each other when the door is closed to a closed position.

Even though the invention has been described in relation to a bathroom partition door, it is to be understood that the invention can easily be applied to other doors, such that the force required by the hinge is reduced while the doors remain in closed position. It is also to be understood that use of the phrase "closing mechanism" is not meant to invoke 35 USC 112(f).

What is claimed is:

1. A partition door system comprising:

a partition door, wherein the partition door has a first side opposite a second side defining a door thickness therebetween and having a door pocket between said first and second sides, wherein the door has an upper end and a lower end;

a stile, wherein the stile has a first side opposite a second side defining a stile thickness therebetween, and having a stile pocket between the first and second sides of the stile, wherein the stile has an upper end and a lower end;

a closing mechanism coupling the partition door to the stile, wherein the closing mechanism provides a force for closing the door relative to the stile;

a first magnet at least partly within the pocket of the partition door proximate an upper end of the partition door and proximate the stile; and a second magnet at least partly within the pocket of the stile proximate an upper end of the stile and proximate the door;

a third magnet proximate the lower end of the partition door;

a fourth magnet proximate the lower end of the stile;

a first member at an end of the partition door proximate at least one of the first magnet and the third magnet; and a second member proximate an end of the stile proximate at least one of the second magnet and the fourth magnet, wherein at least one of the first and third magnets is sandwiched between the partition door and the first member and wherein at least one of the second and fourth magnets is sandwiched between the stile and the second member.

2. The system of claim 1, wherein the partition door rotates about a longitudinal axis between the partition door and the stile.

3. The system of claim 1, wherein one of the first and second members defines a longitudinally extending channel and wherein the other of the first and second members defines a longitudinally extending projection and wherein when the partition door is in a closed position said longitudinally extending projection is received within said longitudinally extending channel.

4. The system of claim 1, wherein the first magnet is sandwiched between the door thickness, the first side of the door, the second side of the door and the first member and wherein the second magnet is sandwiched between the stile thickness, the first side of the stile, the second side of the stile and the second member.

5. A partition wall member comprising:

a body comprising, a first end for coupling to another partition wall member, a second end opposite the first end, a first side opposite a second side defining a thickness therebetween, and having a pocket between the first and second sides;

a first magnet at or proximate the second end, and at least partly within the pocket, wherein the body has an upper end and a lower end, wherein said first magnet is closer to the upper end of the partition wall member than the lower end of the body, and the body further comprises a second magnet closer to the lower end of the body than the upper end of the body; and an end member at an end of the body proximate at least one of the first and second magnets for interfacing with another end member at an end of another partition wall member.

6. The partition wall member of claim 5, wherein the end member comprises at least one of a longitudinally extending channel or a longitudinally extending projection.

7. The partition wall member of claim 5, wherein the partition wall member is a door and the another partition wall member is a stile.

8. The partition wall member of claim 5, wherein the partition wall member is a stile and the another partition wall member is a door.

9. The partition wall member of claim 5, wherein said end member comprises a longitudinally extending channel and said another end member comprises a longitudinally extending projection.

10. The portion wall member of claim 5, wherein the first magnet is sandwiched between the end member and the body.

11. A partition door system comprising:

a partition door;

a stile;

a first magnet mounted to the partition door proximate the stile;

a second magnet mounted to the stile proximate the door, a first member at an end of the partition door proximate the first magnet; and a second member proximate an end of the stile proximate the second magnet, wherein one of the first and second member defines a longitudinally extending channel and wherein the other of the first and second members defines a longitudinally extending projection and wherein when the partition door is in a closed position said longitudinally extending projection is received within said longitudinally extending channel.

12. The system of claim 11, wherein the first magnet sandwiched between the door and the first member and wherein the second magnet is sandwiched between the stile and the second member.

13. A partition door system comprising:

a partition door, wherein the partition door has a first side opposite a second side defining a door thickness therebetween and having a door pocket between said first and second sides, wherein the door has an upper end and a lower end;

a stile, wherein the stile has a first side opposite a second side defining a stile thickness therebetween and having a stile pocket between the first and second sides of the stile, wherein the stile has an upper end and a lower end;

a first magnet at least partly within the door pocket proximate the stile, wherein the first magnet is mounted closer to the upper end of the partition door than the lower end of the partition door; and a second magnet at least partly within the stile pocket proximate the door, wherein the second magnet is mounted closer to the upper end of the stile than the lower end of the stile;

a third magnet spaced apart from the first magnet and at least partly within another pocket of the partition door closer to the lower end of the partition door than the upper end of the partition door;

a fourth magnet spaced apart from the second magnet and at least partly within another pocket the stile closer to the lower end of the stile than the upper end of the stile;

a first member at an end of the partition door proximate at least one of the first magnet and the third magnet; and a second member proximate an end of the stile proximate at least one of the second magnet and the fourth magnet, wherein at least one of the first and third magnets is sandwiched between the door and the first member and wherein at least one of the second and fourth magnets is sandwiched between the stile and the second member.

14. The system of claim 13, wherein the partition door rotates about a longitudinal axis between the partition door and the stile.

15. The system of claim 13, wherein one of the first and second members defines a longitudinally extending channel and wherein the other of the first and second members defines a longitudinally extending projection and wherein when the partition door is in a closed position said longitudinally extending projection is received within said longitudinally extending channel.

16. The system of claim 13, wherein the first magnet sandwiched between the door thickness, the first side of the door, the second side of the door and the first member and wherein the second magnet is sandwiched between the stile thickness, the first side of the stile, the second side of the stile and the second member.

* * * * *